US006900005B2

(12) United States Patent
Weimann et al.

(10) Patent No.: US 6,900,005 B2
(45) Date of Patent: May 31, 2005

(54) COLOR PHOTOGRAPHIC PRINT MATERIAL

(75) Inventors: Ralf Weimann, Leverkusen (DE); Markus Geiger, Cologne (DE); Axel Jochum, Cologne (DE)

(73) Assignee: Agfa-Gevaert (BE)

( * ) Notice: Subject to any disclaimer, the term of this patent is extended or adjusted under 35 U.S.C. 154(b) by 249 days.

(21) Appl. No.: 10/612,276

(22) Filed: Jul. 2, 2003

(65) Prior Publication Data

US 2004/0023172 A1 Feb. 5, 2004

(30) Foreign Application Priority Data

Jul. 10, 2002 (DE) ..... 102 30 984

(51) Int. Cl.[7] ..... G03C 1/08; G03C 7/26; G03C 7/32

(52) U.S. Cl. ..... 430/553; 430/552; 430/558

(58) Field of Search ..... 430/552, 553, 430/543, 558, 567

(56) References Cited

U.S. PATENT DOCUMENTS

| | | | | |
|---|---|---|---|---|
| 5,922,526 | A | 7/1999 | Missfeldt | 430/584 |
| 6,534,254 | B1 | 3/2003 | Helling et al. | |
| 6,558,887 | B2 * | 5/2003 | Helling et al. | 430/553 |
| 2003/0064331 | A1 | 4/2003 | Ly et al. | 430/552 |

FOREIGN PATENT DOCUMENTS

| | | |
|---|---|---|
| DE | 196 46 855 | 5/1998 |
| DE | 100 55 094 | 5/2002 |
| DE | 101 01 221 | 7/2002 |
| EP | 0 571 959 | 12/1993 |
| EP | 1 113 327 | 7/2001 |
| EP | 1 113 329 | 7/2002 |
| GB | 2 316 495 | 2/1998 |
| JP | 3-98049 | 4/1991 |

OTHER PUBLICATIONS

Konica Corp., "Silver Halide Photographic Sensitive Material", vol. 015, no. 287, 1991.

* cited by examiner

*Primary Examiner*—Geraldine Letscher
(74) *Attorney, Agent, or Firm*—Connolly Bove Lodge & Hutz LLP

(57) ABSTRACT

A color photographic print material having at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterized in that the cyan coupler is of the formula (II)

in which
$R^6$–$R^9$, X and Z are defined in the specification,
and the magenta coupler is of the formula (I)

in which
$R^1$–$R^5$, Y, A, B and n are defined in the specification, and is distinguished by good color reproduction, dark stability and light stability.

5 Claims, No Drawings

COLOR PHOTOGRAPHIC PRINT MATERIAL

This invention relates to a colour photographic print material having a combination of specific magenta couplers and specific cyan couplers.

Colour photographic print materials are in particular materials for reflection prints or displays, which most usually exhibit a positive image. They are thus not a recording material like colour photographic films.

Colour photographic print materials conventionally contain at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler.

EP 571 959 discloses novel magenta couplers which are distinguished by pure colours and excellent stability of the dyes produced therefrom. They are of the formula (I)

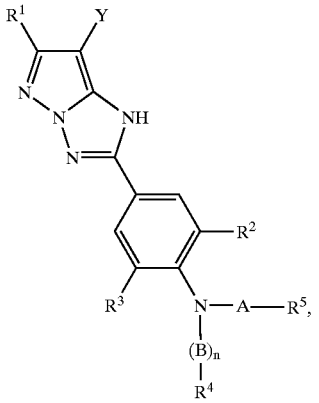

in which $R^1$ means a tertiary alkyl residue, $R^2$ and $R^3$ each mean a hydrogen atom or a substituent group, Y means a hydrogen atom, a halogen atom or an aryloxy residue, A and B each mean —CO— or —$SO_2$—, n means 0 or 1, $R^4$ means a hydrogen atom, an alkyl residue or an aryl residue and $R^5$ means an alkyl residue, an aryl residue, an alkoxy residue, an alkylamino residue or an arylamino residue or $R^4$ and $R^5$ may be joined together to form a five-, six- or seven-membered ring, and are used together with known cyan couplers, for example with the following compounds BG-1 to BG-5

BG-1

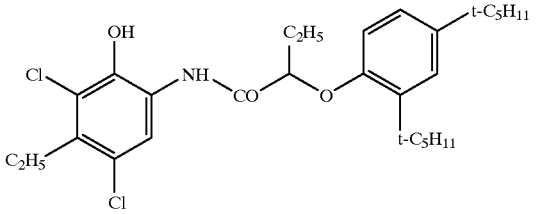

-continued

BG-2

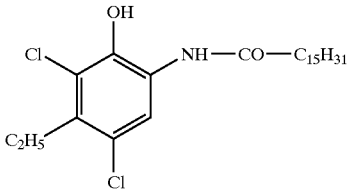

BG-3

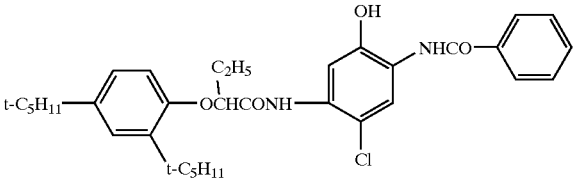

BG-4

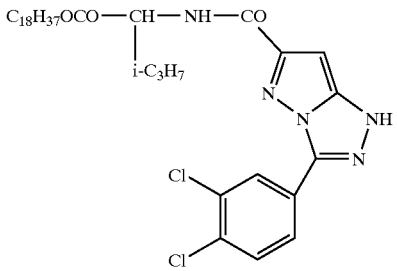

BG-5

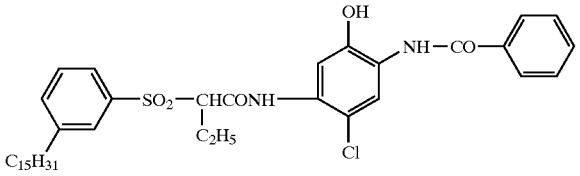

However, this combination has the disadvantage that it is not simultaneously possible to achieve good colour reproduction, dark stability and light stability for cyan and magenta.

The object of the invention was to overcome the above-stated disadvantage. Surprisingly, this is achieved if the magenta couplers of the formula (I) are used together with the cyan couplers of the formula (II).

The present invention accordingly provides a print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the magenta coupler is of the formula (I) and the cyan coupler is of the formula (II)

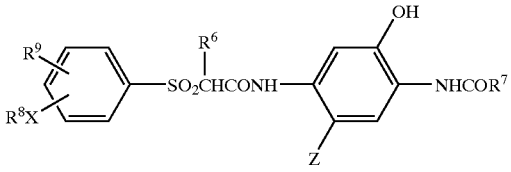

wherein in the formula (II)

$R^6$ means a hydrogen atom or an alkyl group, $R^7$ means an alkyl, aryl or hetaryl group, $R^8$ means an alkyl or aryl group, $R^9$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom, Z means a hydrogen atom or a group eliminable under the conditions of chromogenic development, X means S, NH or $NR^{10}$ and $R^{10}$ means an alkyl or aryl group.

The following meanings preferably apply:

$R^6$=an alkyl group;

$R^7$=unsubstituted or substituted phenyl, thienyl or thiazolyl group;

$R^8$=alkyl group;

$R^9$=hydrogen atom;

Z=Cl;

X=S.

The cyan coupler is particularly preferably of the formula (II-A)

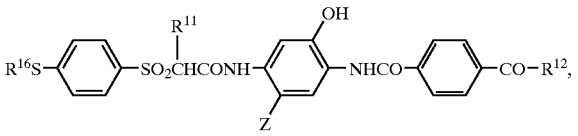

in which $R^{11}$means a hydrogen atom or an alkyl group, $R^{12}$ means $OR^{13}$ or $NR^{14}R^{15}$, $R^{13}$ means an unsubstituted or substituted alkyl group with 1 to 6 C atoms, $R^{14}$ means an unsubstituted or substituted alkyl group with 1 to 6 C atoms, $R^{15}$ means a hydrogen atom or an unsubstituted or substituted alkyl group with 1 to 6 C atoms, $R^{16}$ means an unsubstituted or substituted alkyl group and Z means a hydrogen atom or a group eliminable under the conditions of chromogenic development and wherein the total number of the C atoms of the alkyl groups $R^{13}$ to $R^{16}$ in a coupler molecule is 8 to 18.

The alkyl groups can be straight chain, branched or cyclic and the alkyl, aryl and hetaryl groups can be substituted, for example, by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, wherein a heterocyclyl represents a saturated, unsaturated or aromatic heterocyclic radical and an acyl represents the radical of an aliphatic, olefinic or aromatic carboxylic, carbamic, carbonic, sulphonic, amidosulphonic, phosphoric, phosphonic, phosphorous, phosphinic or sulphinic acid.

Preferably the alkyl groups can be substituted, for example, by alkyl, alkylene, hydroxy, alkoxy or acyloxy groups and most preferably by hydroxy or alkoxy groups. Preferred substituents for aryl and hetarylgroups are halogen, in particular Cl and F, alkyl, fluorinated alkyl, cyano, acyl, acylamino or carboxy groups.

Suitable cyan couplers are:

II-1

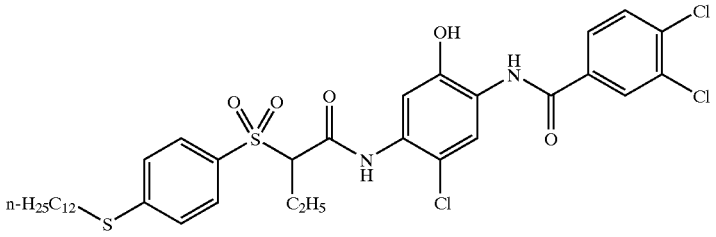

II-2

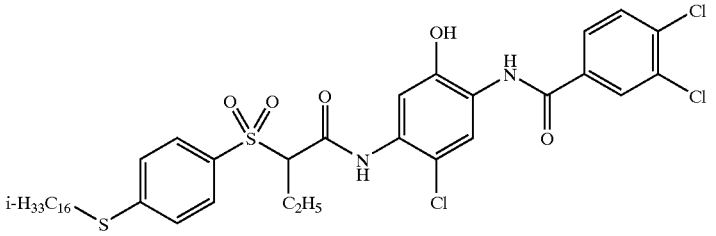

II-3

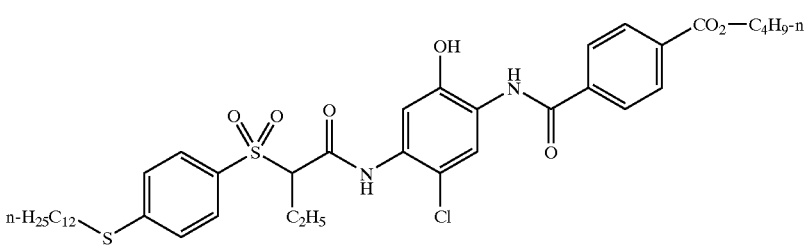

-continued
II-4
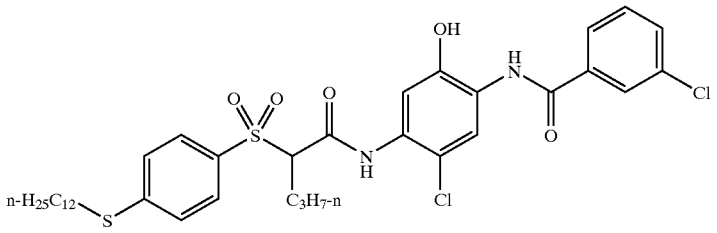
II-5
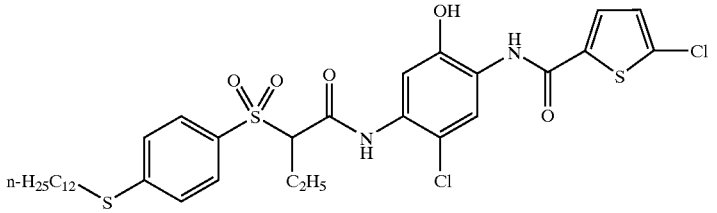
II-6
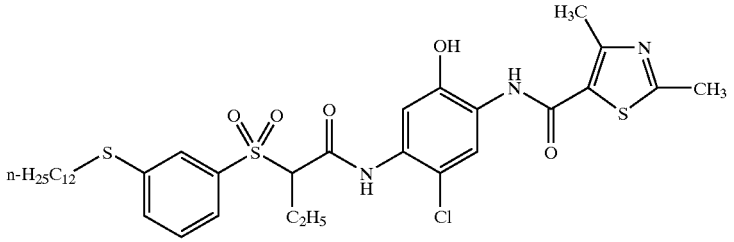
II-7
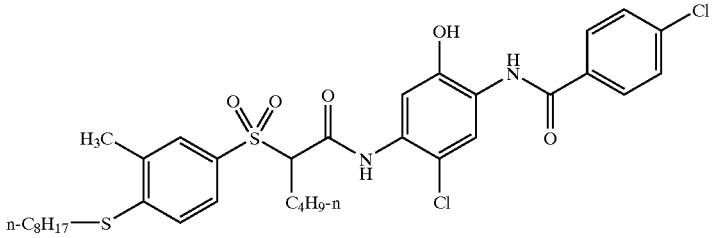
II-8
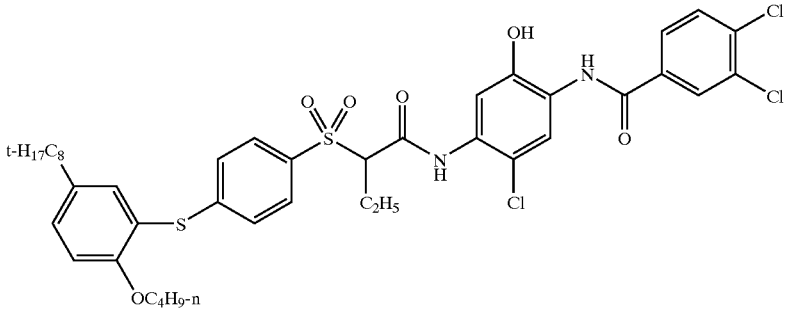

-continued
II-9
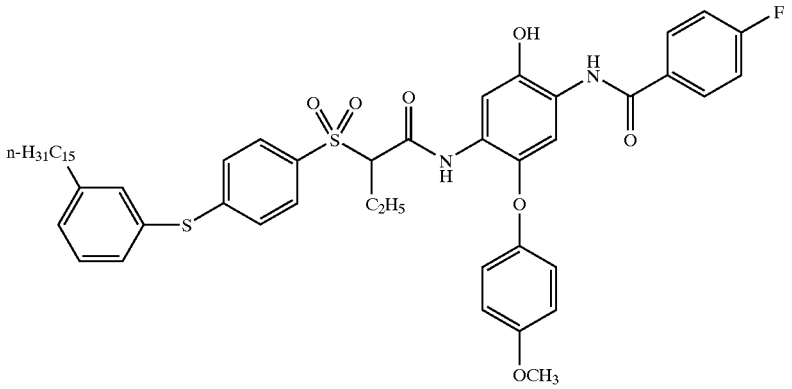
II-10
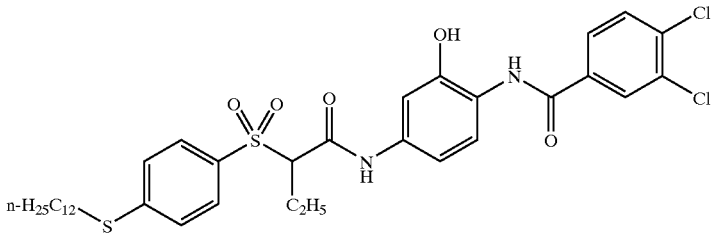
II-11
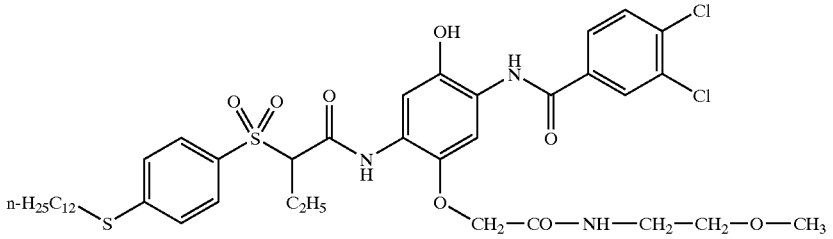
II-12
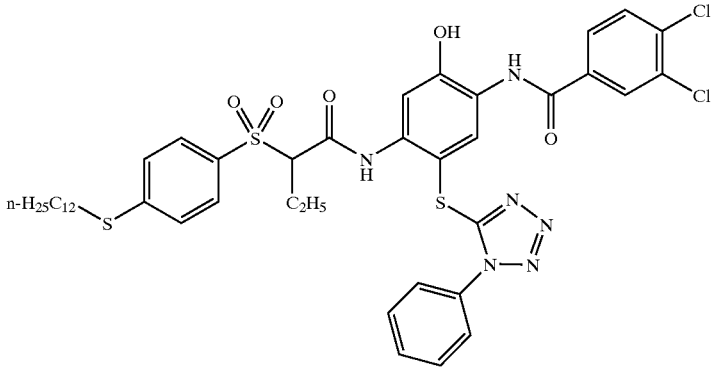
II-13
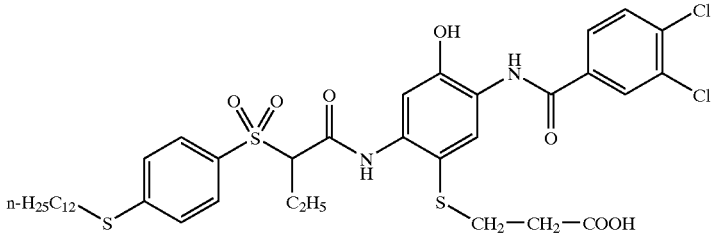

-continued
II-14
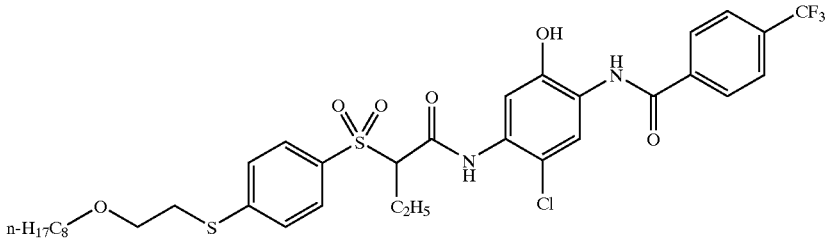
II-15
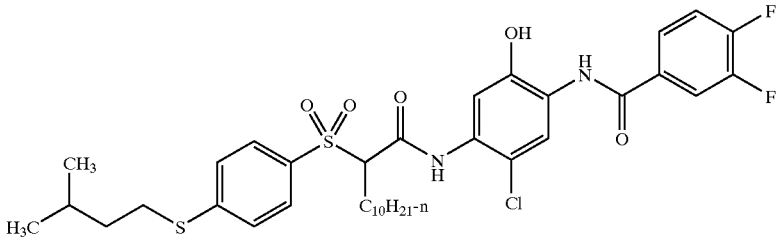
II-16
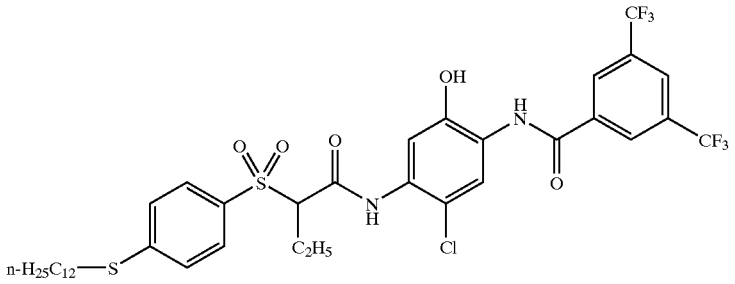
II-17
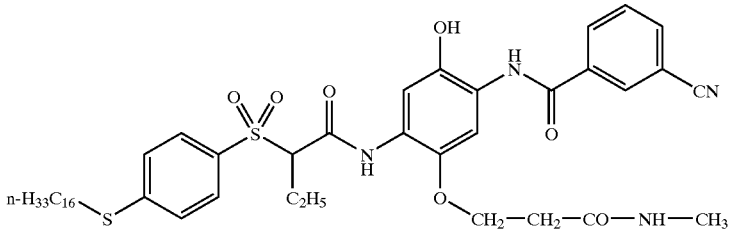
II-18
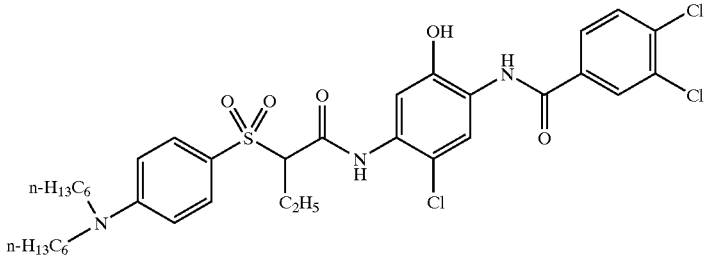
II-19
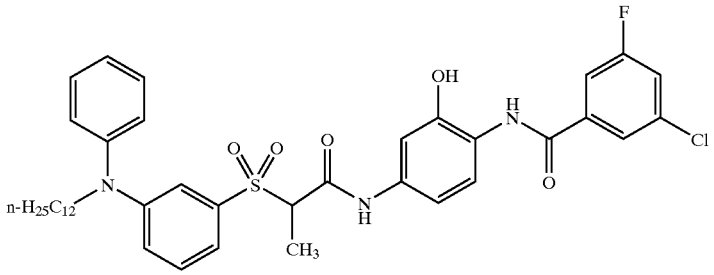

-continued
II-20
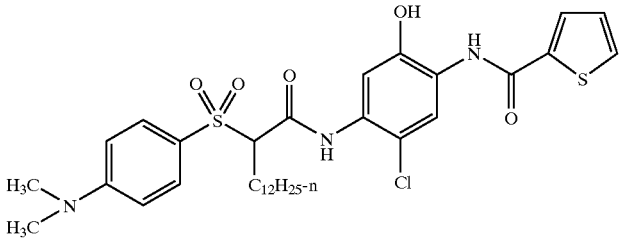
II-21
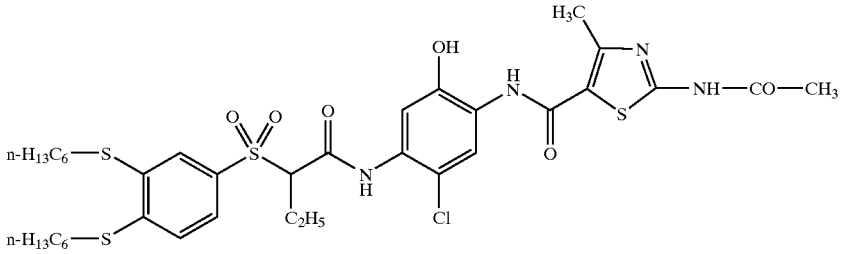
II-22
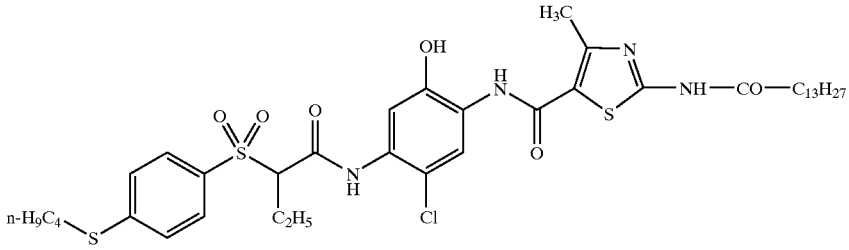
II-23
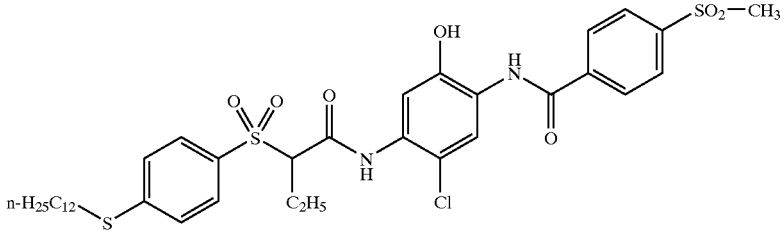
II-24
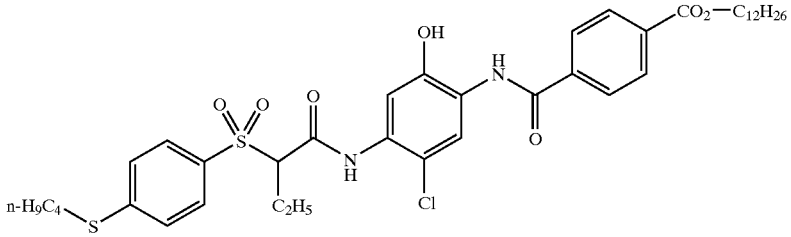
II-25
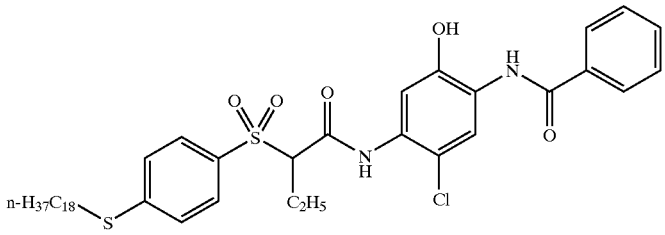

-continued
II-26
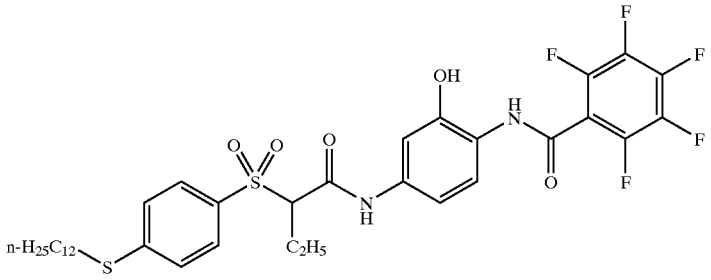
II-27
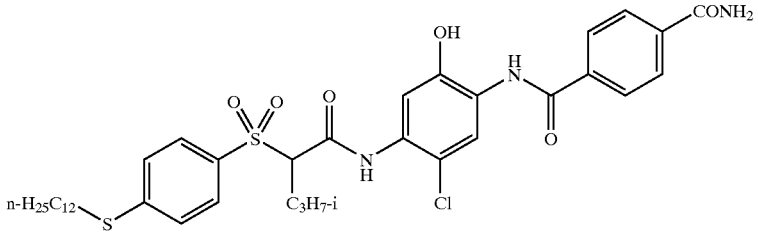
II-28
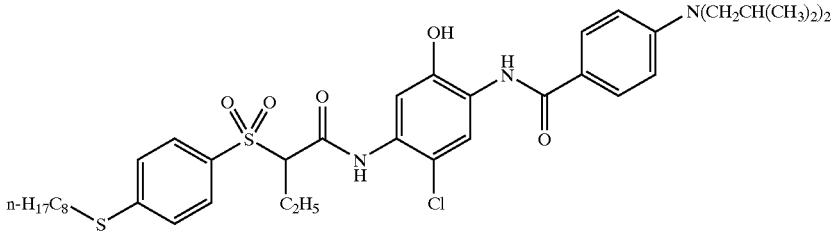
II-29
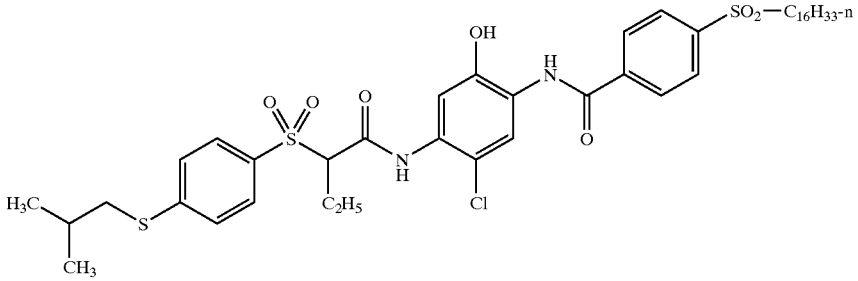
II-30
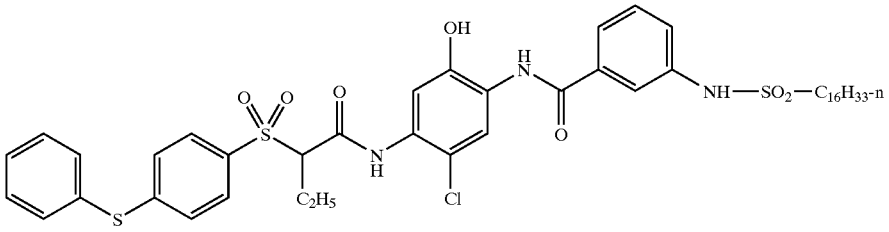
II-31
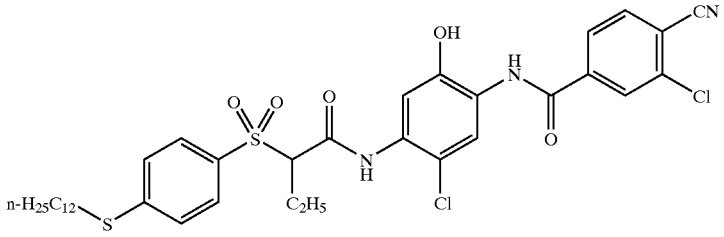

-continued
II-32
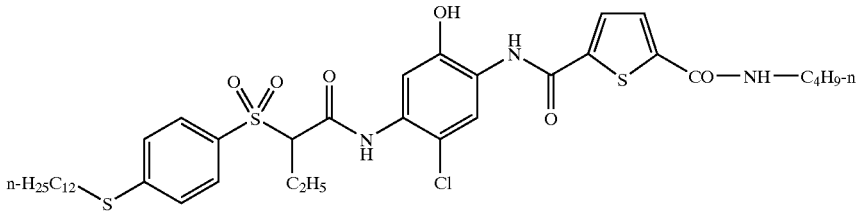
II-33
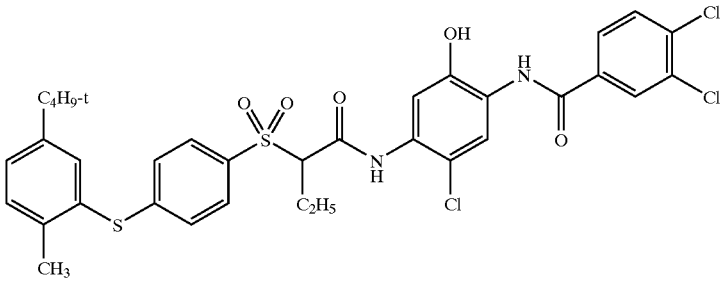
II-34
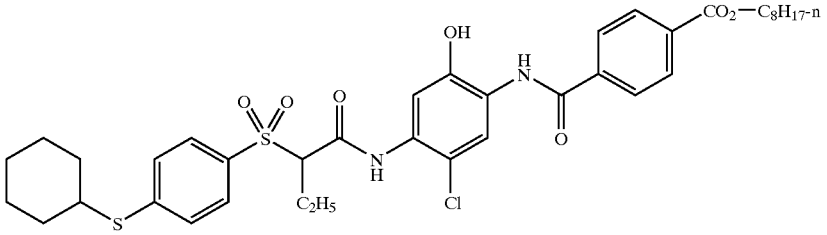
II-35
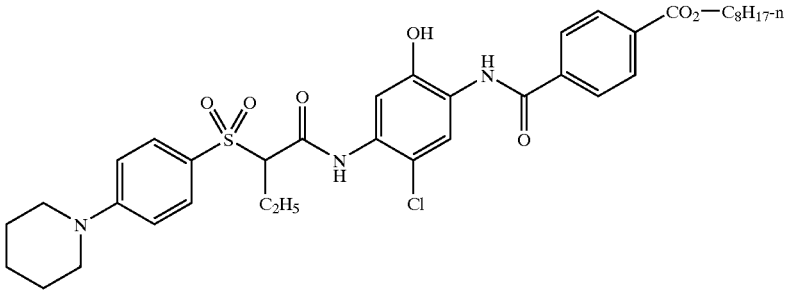
II-36
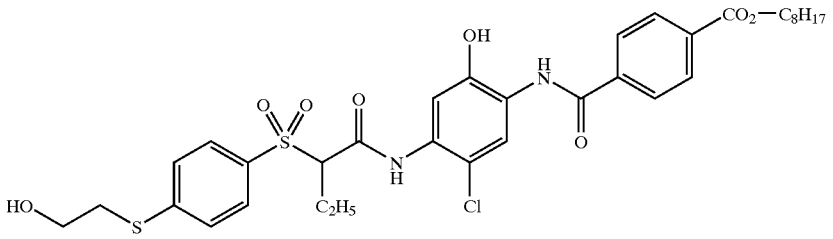
II-37
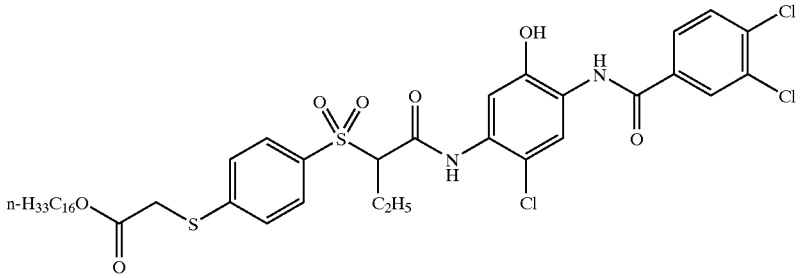

-continued
II-38
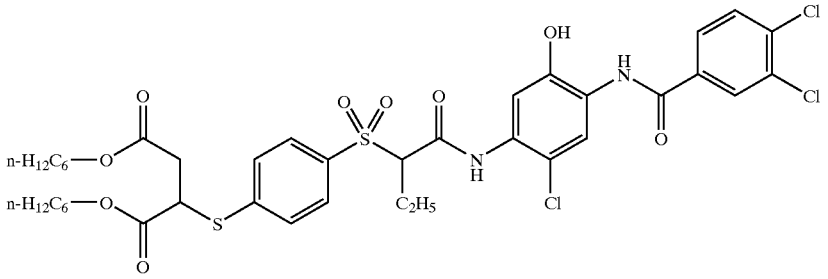
II-39
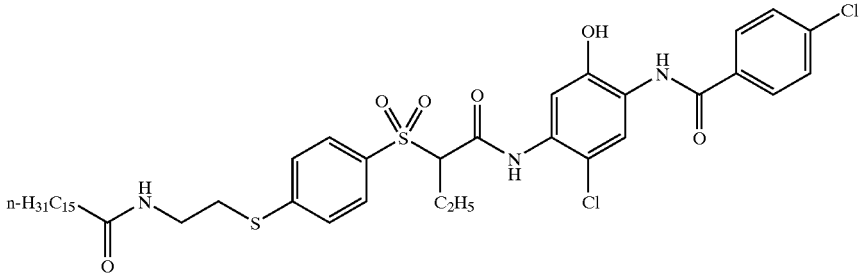
II-40
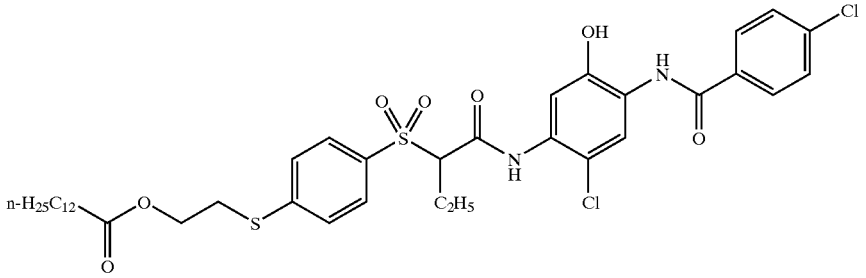
II-41
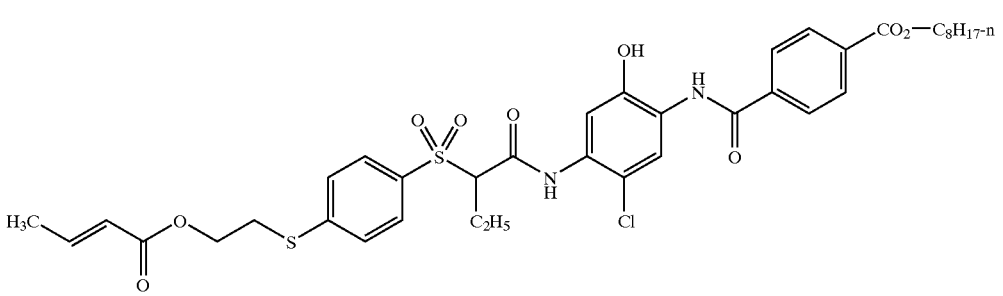
II-42
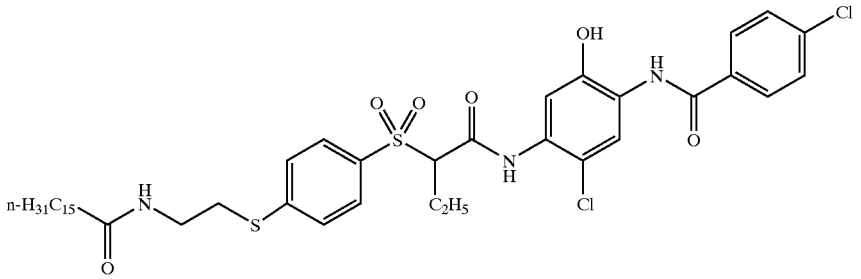

-continued
II-43
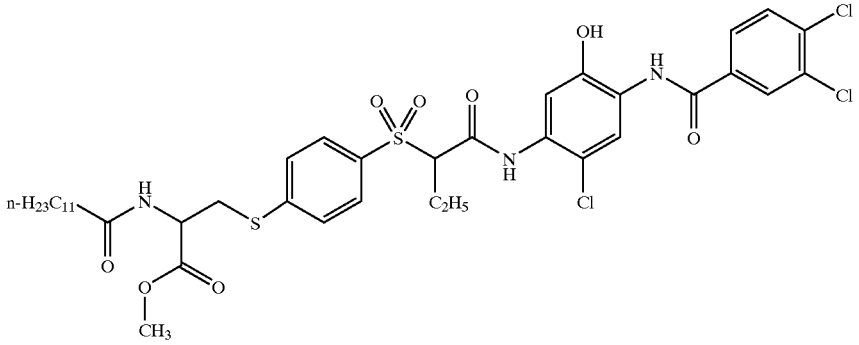
II-44
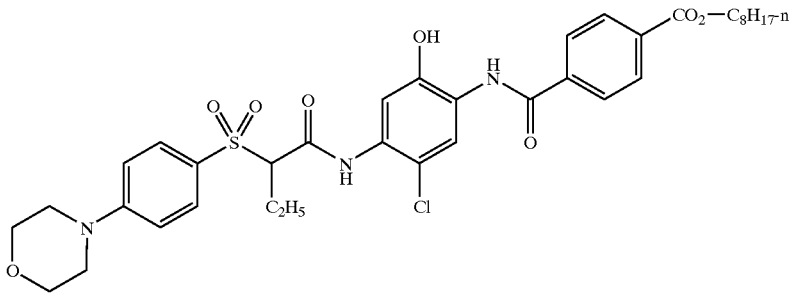
II-45
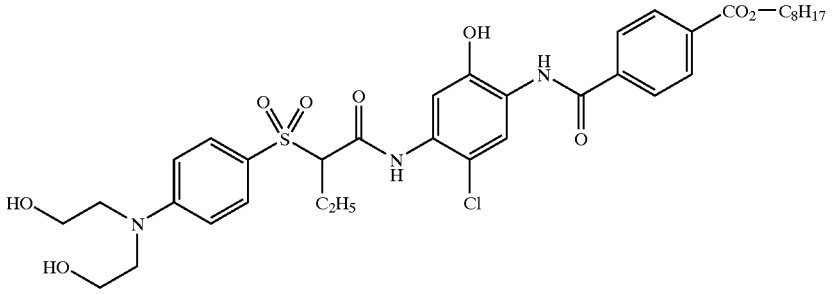
II-46
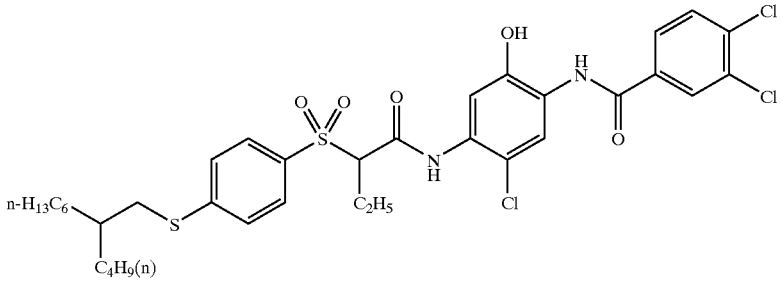
II-47
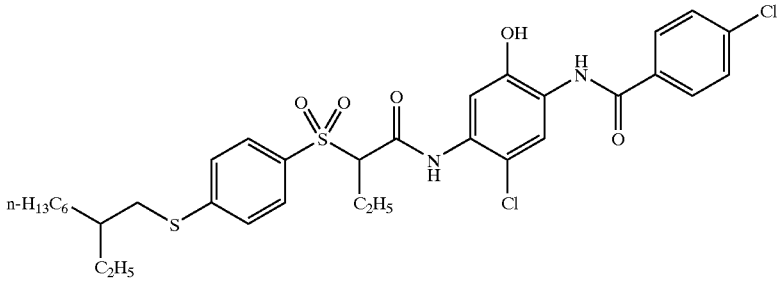

-continued

II-48

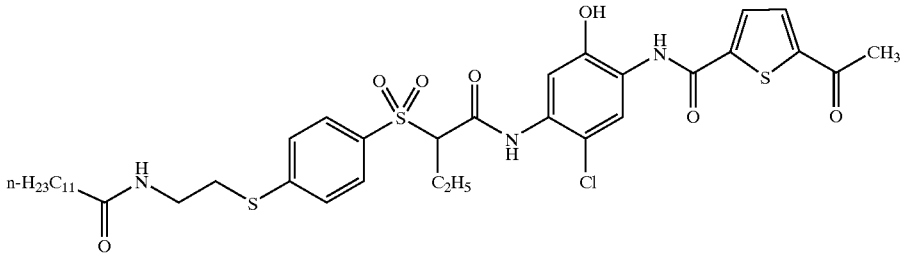

Synthesis of Coupler II-1

Synthesis of the Phenolic Coupler Intermediate

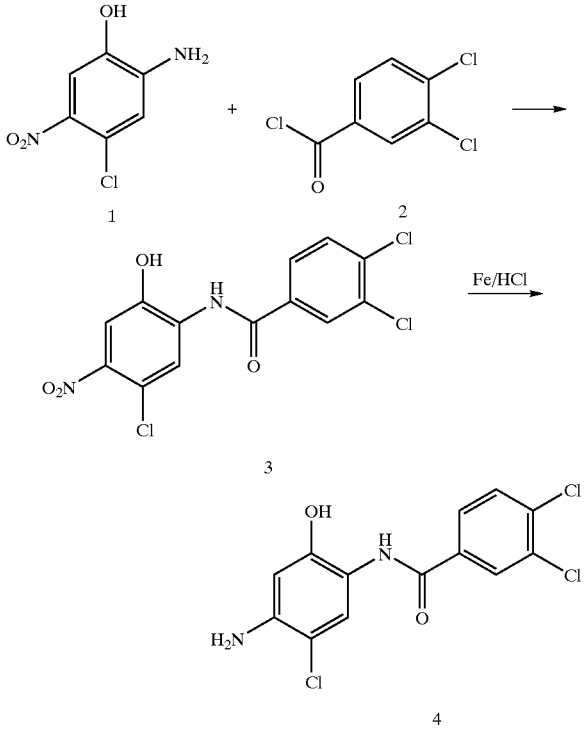

A solution of 185 g (0.87 mol) of 3,4-dichlorobenzoyl chloride 2 in 50 ml of N-methylpyrrolidone is added dropwise with stirring to 165 g (0.87 mol) of 2-amino-4chloro-5-nitrophenol 1 in 500 ml of N-methylpyrrolidone. Continue stirring for 1 hour at room temperature and then for 2 hours at 60–65° C. After cooling, slowly combine with 500 ml of water and suction filter. Stir twice with water and then twice with methanol and suction filter.

Yield 310 g (98%) of 3

A mixture of 310 g (0.86 mol) of 3, 171 g of iron powder, 2.2 l of ethanol and 700 ml of N-methylpyrrolidone is heated to 65° C. while being stirred. The heating bath is removed and 750 ml of conc. hydrochloric acid are added dropwise within 2 hours. The mixture is then refluxed for 1 hour. After cooling, 1 l of water is added, the mixture suction filtered and washing performed with 2 N hydrochloric acid, then with water until the outflowing water is colourless. The residue is stirred together with 1.5 l of water, the mixture neutralised by addition of sodium acetate and suction filtered. Stir twice more with 1.5 l of methanol and suction filter.

Yield 270 g (95%) of 4

Synthesis of the Ballast Residue

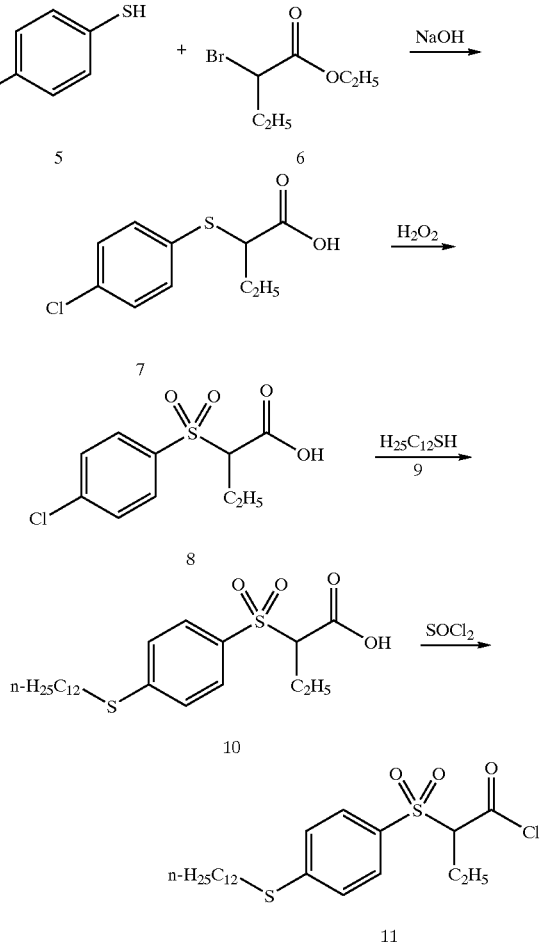

A 320 g (3.6 mol) of 45% sodium hydroxide solution are added dropwise within 1 hour with stirring to a mixture of 520 g (3.6 mmol) of 4-chlorothiophenol 5 and 652 g (3.6 mol) of 2-bromobutyric acid ethyl ester 6 in 1 l of ethanol. The reaction is strongly exothermic, the temperature being kept at 75–80° C. by cooling, and the mixture is then refluxed for 1 hour. A further 400 g (4.5 mol) of sodium hydroxide solution are slowly added dropwise (weakly exothermic). After refluxing for a further 2 hours, the mixture is cooled and 1 l of water is added. Extraction is then performed twice with 250 ml of toluene, the combined organic phases are dried and evaporated in the rotary evaporator. The viscous oil 7 (830 g, still contains toluene) is further reacted without purification.

760 ml of hydrogen peroxide (35%) are added dropwise to a solution of 830 g (3.6 mol) of compound 7 and 10 ml of sodium tungstate solution (20%) in glacial acetic acid: the first 300 ml initially with cooling at 35–40° C. and, after removal of the cooling, the remaining 360 ml at 90–95° C. Once addition is complete, stirring is continued for 1 hour at this temperature. Excess peroxide is destroyed by addition of sodium sulfite. The reaction mixture is combined with 2 l of ethyl acetate and 2 l of water, the organic phase is separated and the aqueous phase extracted twice with 700 ml portions of ethyl acetate. The combined organic phases are washed twice with 700 ml portions of water, dried and evaporated under a vacuum. The residue is dissolved in 300 ml of hot ethyl acetate, cooled and, at the onset of crystallisation, combined with 1 l of hexane. The mixture is then suction filtered when cold and rewashing performed with a little hexane. 835 g (88%) of the compound 8 are obtained.

131 g (0.5 mol) of 8 and 111 g (0.55 mol) of dodecyl mercaptan 9 in 300 ml of 2-propanol are combined with stirring with 90 g (1 mol) of sodium hydroxide solution (45%). After the addition of 2.5 g of tetrabutylammonium bromide and 2.5 g of potassium iodide, the mixture is refluxed for 11 hours. After cooling, 350 ml of water are added and the pH is adjusted to 1–2 with approx. 60 ml of conc. hydrochloric acid. Extraction is then performed twice with 100 ml portions of ethyl acetate, the combined organic phases are washed three times with 150 ml portions of water, dried and evaporated. The residue is stirred together with 500 ml of hexane and the mixture suction filtered at 0–5° C. After recrystallisation from 500 ml of hexane/ethyl acetate (10:1), 177 g of 10 are obtained (82%, m.p.: 82° C.).

128 g.(0.3.mol) of 10 and 1 ml of dimethylformamide are heated to 65° C. in 300 ml of toluene. 75 ml (1 mol) of thionyl chloride are added dropwise at this temperature within 1 hour. After a further 5 hours, the mixture is evaporated under a vacuum.

The highly viscous oil (11, 134 g) is used without further purification.

Synthesis of Coupler II-1

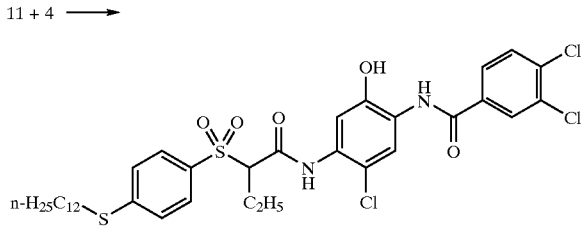

I-1

100 g of the crude product 11 (approx. 0.2 mol) in 100 ml of N-methylpyrrolidone are added dropwise at 5–10° C. to 66 g (0.2 mol) of 4 in 200 ml of N-methylpyrrolidone. The mixture is stirred, initially for 2 hours at room temperature, then for 2 hours at 60° C. The reaction mixture is filtered while hot, the filtrate combined with 500 ml of acetonitrile, cooled to 0° C., suction filtered and rewashed with 50 ml of acetonitrile. The product is combined with 500 ml of methanol and 1 l of water, stirred, suction filtered, then rewashed with 300 ml of water and dried.

Yield: 120 g (81%) of I-1

Examples of magenta couplers of the formula (I) are:

I-1

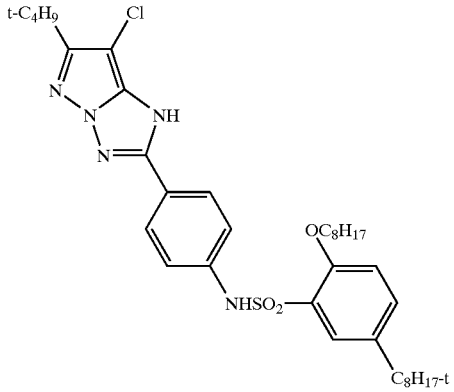

I-2

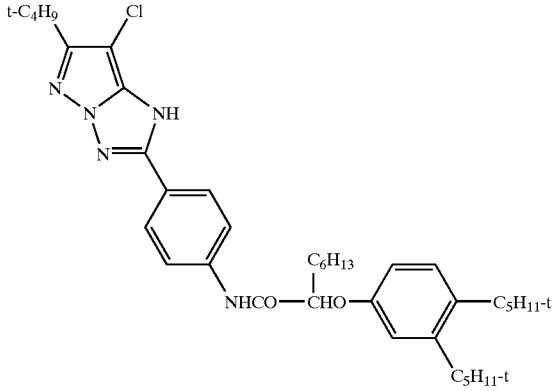

I-3

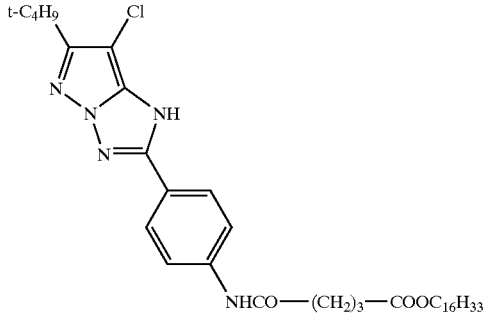

I-4

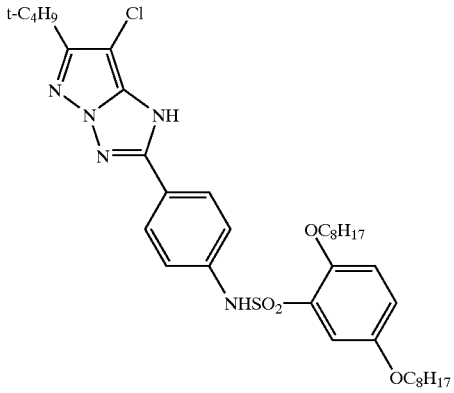

-continued
I-5
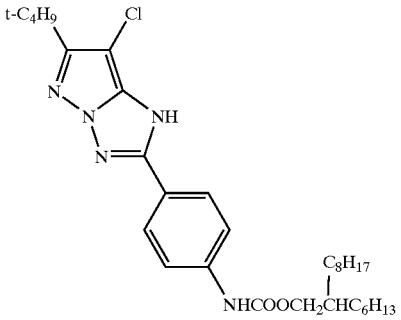
I-6
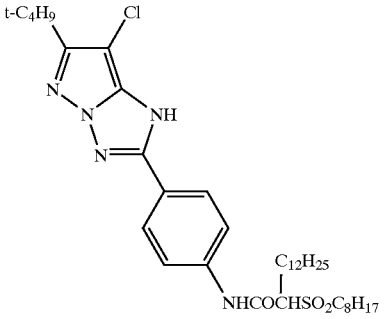
I-7
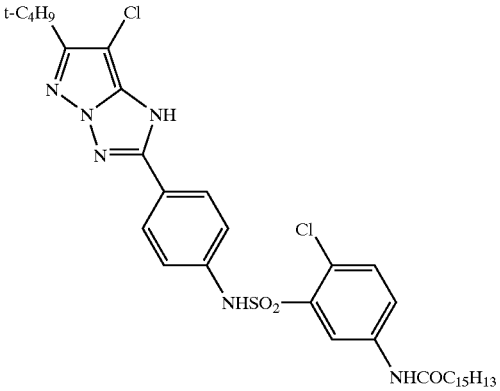
I-8
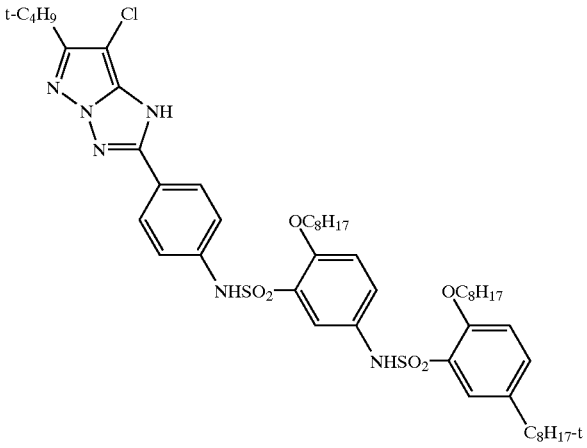
-continued
I-9
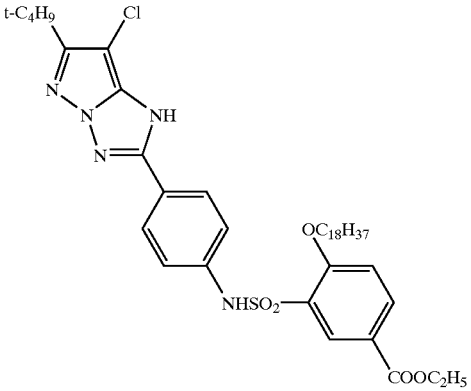
I-10
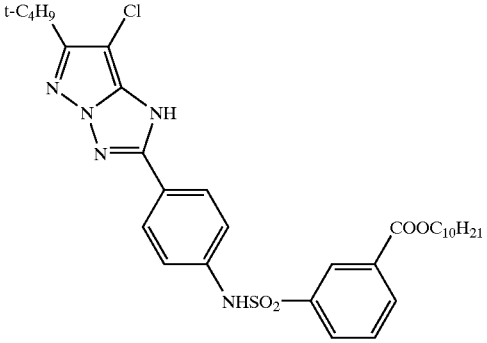
I-11
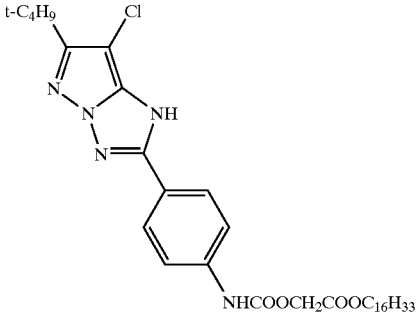
I-12
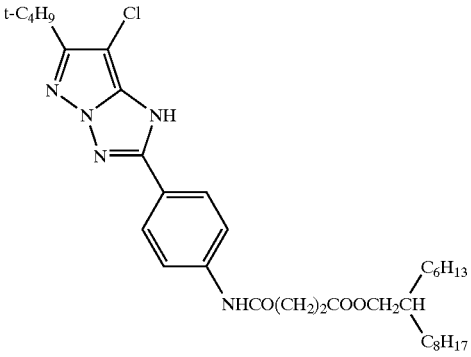

-continued
I-13
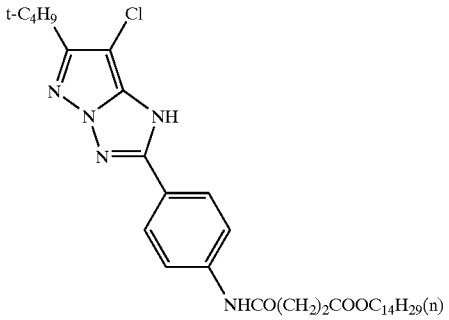
I-14
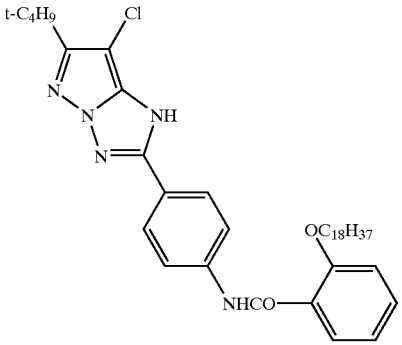
I-15
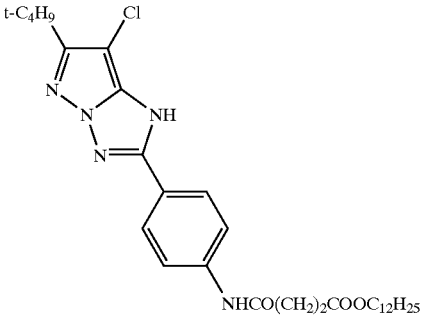
I-16
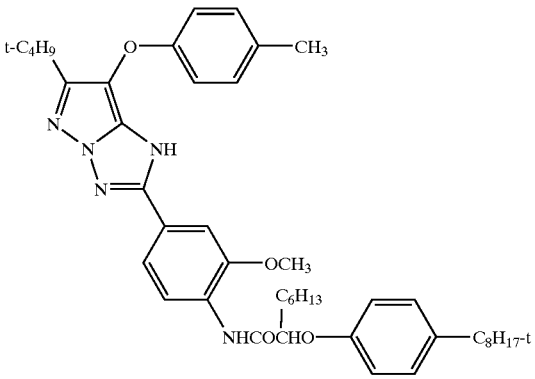
-continued
I-17
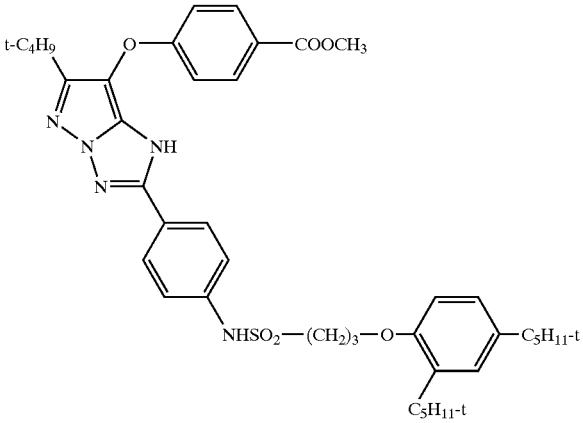
I-18
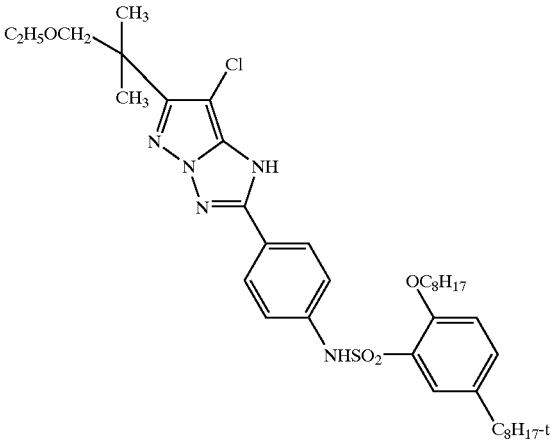
I-19
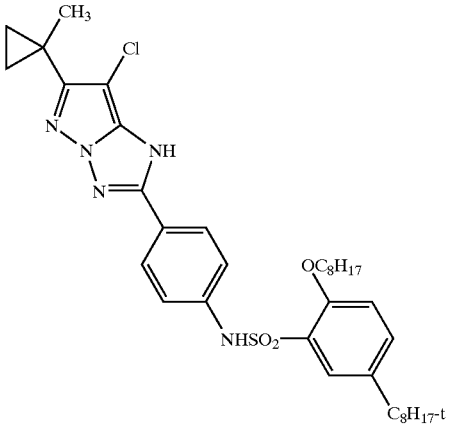
Examples of colour photographic print materials are colour photographic paper, colour reversal photographic paper and semi-transparent display material. A review may be found in Research Disclosure 37038 (1995), Research Disclosure 38957 (1996) and Research Disclosure 40145 (1997).

Photographic print materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The colour photographic print materials conventionally contain at least one red-sensitive, one green-sensitive and one blue-sensitive silver halide emulsion layer, optionally together with interlayers and protective layers.

Depending upon the type of photographic print material, these layers may be differently arranged. This is demonstrated for the most important products:

Colour photographic paper and colour photographic display material conventionally have on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; a yellow filter layer is not necessary.

The number and arrangement of the photosensitive layers may be varied in order to achieve specific results. Colour papers, for example, may also contain differently sensitised interlayers, by means of which gradation may be influenced.

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Further red sensitisers which may be considered for the red-sensitive layer are pentamethinecyanines having naphthothiazole, naphthoxazole or benzothiazole as basic end groups, which may be substituted with halogen, methyl or methoxy groups and may be bridged by 9,11-alkylene, in particular 9,11-neopentylene; The N,N' substituents may be $C_4$–$C_8$ alkyl groups. The methine chain may additionally also bear substituents. Pentamethines having only one methyl group on the cyclohexene ring may also be used. The red sensitiser may be supersensitised and stabilised by the addition of heterocyclic mercapto compounds.

The red-sensitive layer additionally be spectrally sensitised between 390 and 590 nm, preferably at 500 nm, in order to bring about improved differentiation of red tones.

The spectral sensitisers may be added to the photographic emulsion in dissolved form or as a dispersion. Both the solution and dispersion may contain additives such as wetting agents or buffers.

The spectral sensitiser or a combination of spectral sensitisers may be added before, during or after preparation of the emulsion.

Photographic print materials contain either silver chloride-bromide emulsions containing up to 80 mol % of AgBr or silver chloride-bromide emulsions containing above 95 mol % of AgCl.

Apart from the cyan and magenta couplers according to the invention, the materials contain yellow couplers and optionally further cyan and magenta couplers blended with the couplers according to the invention.

Details of colour couplers may be found in Research Disclosure 37254, part 4 (1995), page 288, in Research Disclosure 37038, part II (1995), page 80 and in Research Disclosure 38957, part X.B (1996), page 616. In print materials, the maximum absorption of the dyes formed from the couplers and the colour developer oxidation product is preferably within the following ranges: yellow coupler 440 to 450 nm, magenta coupler 540 to 560 nm, cyan coupler 625 to 670 nm.

The yellow couplers associated with a blue-sensitive layer in print materials are almost always two-equivalent couplers of the pivaloylacetanilide and cyclopropylcarbonylacetanilide series.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), 95 et seq. and in Research Disclosure 38957, parts XVIII, XIX and XX (1996), pages 630 et seq. together with example materials.

EXAMPLES

Example 1

A colour photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

| Layer structure 101 |
|---|
| Layer 1: (Substrate layer) |
| 0.10 g of gelatine |
| Layer 2: (Blue-sensitive layer) |
| Blue-sensitive silver halide emulsion (99.5 mol % chloride, 0.5 mol % bromide, average grain diameter 0.75 μm) prepared from 0.4 g of $AgNO_3$. |
| 1.25 g of gelatine |
| 0.50 g of yellow coupler GB-1 |
| 0.30 g of tricresyl phosphate (TCP) |
| 0.10 g of stabiliser ST-1 |
| Layer 3: (Interlayer) |
| 0.10 g of gelatine |
| 0.06 g of DOP scavenger SC-1 |
| 0.06 g of DOP scavenger SC-2 |
| 0.12 g of TCP |
| Layer 4: (Green-sensitive layer) |
| Green-sensitive silver halide emulsion (99.5 mol % chloride, 0.5 mol % bromide, average grain diameter 0.45 μm) prepared from 0.2 g of $AgNO_3$. |
| 1.10 g of gelatine |
| 0.12 g of magenta coupler PP-1 |
| 0.40 g of TCP |
| Layer 5: (UV protective layer) |
| 1.05 g of gelatine |
| 0.35 g of UV absorber UV-1 |
| 0.10 g of UV absorber UV-2 |
| 0.05 g of UV absorber UV-3 |
| 0.06 g of DOP scavenger SC-1 |
| 0.06 g of DOP scavenger SC-2 |
| 0.25 g of TCP |
| Layer 6: (Red-sensitive layer) |
| Red-sensitive silver halide emulsion (99.5 mol % chloride, 0.5 mol % bromide, average grain diameter 0.48 μm) prepared from 0.28 g of $AgNO_3$. |
| 1.00 g of gelatine |
| 0.35 g of cyan coupler BG-1 |
| 0.20 g of TCP |
| 0.20 g of dibutyl phthalate |
| Layer 7: (UV protective layer) |
| 1.05 g of gelatine |
| 0.35 g of UV absorber UV-1 |
| 0.10 g of UV absorber UV-2 |
| 0.05 g of UV absorber UV-3 |
| 0.15 g of TCP |
| Layer 8: (Protective layer) |
| 0.90 g of gelatine |
| 0.05 g of optical brightener W-1 |
| 0.07 g of polyvinylpyrrolidone |
| 1.20 ml of silicone oil |
| 2.50 mg of polymethyl methacrylate spacers, average particle size 0.8 μm |
| 0.30 g of instant hardener H-1 |

The other layer structures differ from 101 with regard to the cyan couplers and magenta couplers; C are Comparative Examples; I are Examples according to the invention.

Processing

Samples of the material are exposed under a grey wedge through a red filter and processed as follows.

| a) Colour developer-45 s-35° C. | |
|---|---|
| Triethanolamine | 9.0 g |
| N,N-Diethylhydroxylamine | 4.0 g |
| Diethylene glycol | 0.05 g |
| 3-Methyl-4-amino-N-ethyl-N-methane-sulfonamidoethylaniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-Dihydroxybenzene-3,4,6-trisulfonic acid trisodium salt | 0.3 g |
| make up with water to 1000 ml; pH 10.0 | |
| b) Bleach/fixing bath-45 s-35° C. | |
| Ammonium thiosulfate | 75 g |
| Sodium hydrogen sulfite | 13.5 g |
| Ammonium acetate | 2.0 g |
| Ethylenediaminetetraacetic acid (iron/ammonium salt) | 57 g |
| Ammonia, 25% | 9.5 g |
| make up with vinegar to 1000 ml; pH 5.5 | |
| c) Rinsing-2 min-33° C. | |
| d) Drying | |

The percentage yellow and cyan secondary densities of the cyan layer were then determined at magenta density $D_{magenta}$=1.0 ($SD_{yellow}$, $SD_{cyan}$), as were the percentage yellow and magenta secondary densities at cyan density $D_{cyan}$=1.0 ($SD_{yellow}$, $SD_{magenta}$). The results are shown in Table 1. The samples are also stored in darkness for 42 days at 85° C. and 60% relative humidity and the percentage reductions in density at density 1.0 ($\Delta DD_{1.0}$) were determined. Further samples are exposed to $15 \cdot 10^6$ lux·h of light from a daylight-standardised xenon lamp at 35° C. and 85% relative humidity. The reduction in density at D=1.0 is then determined ($\Delta DL_{1.0}$).

The following compounds are used in Example 1:

GB-1

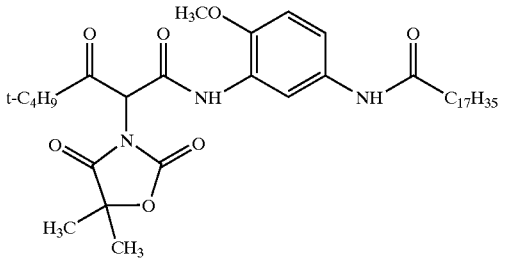

PP-1

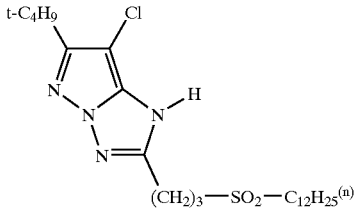

-continued

PP-2

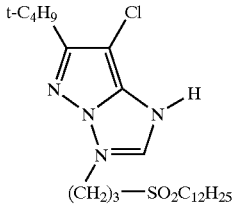

SC-1

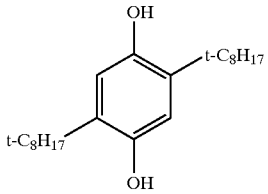

SC-2

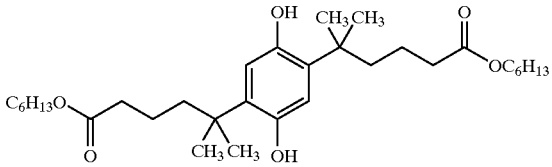

UV-1

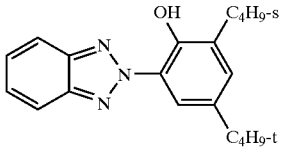

UV-2

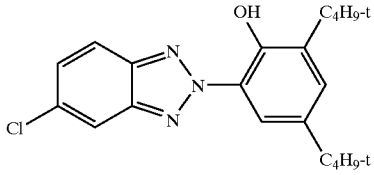

UV-3

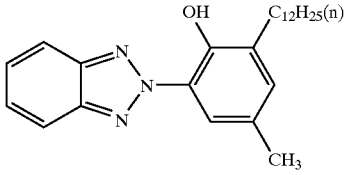

H-1

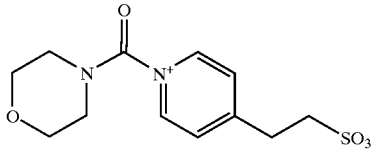

ST-1

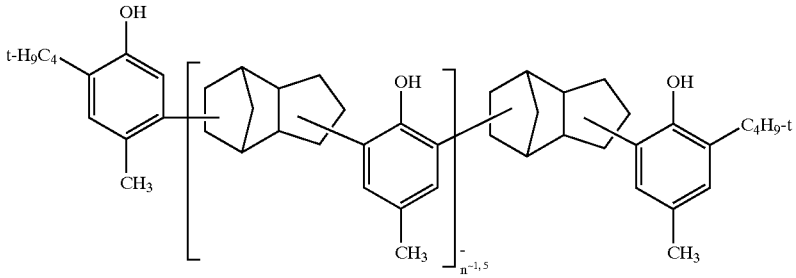

W-1

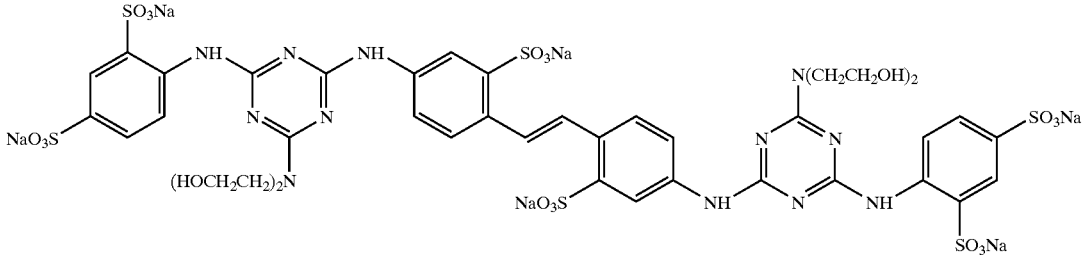

TABLE 1

| Layer structure | Layer 4 Magenta coupler | Layer 6 Cyan coupler | Secondary density (%) Magenta coupler $SD_{yellow}$ | Secondary density (%) Magenta coupler $SD_{cyan}$ | Secondary density (%) Cyan coupler $SD_{yellow}$ | Secondary density (%) Cyan coupler $SD_{magenta}$ | Dark stability $\Delta DD_{1.0}$(%) magenta | Dark stability $\Delta DD_{1.0}$(%) cyan | Light stability $\Delta DL_{1.0}$(%) magenta | Light stability $\Delta DL_{1.0}$(%) cyan |
|---|---|---|---|---|---|---|---|---|---|---|
| 101(C) | PP-1 | BG-1 | 22.6 | 6.4 | 11.8 | 28.6 | −3 | −38 | −47 | −27 |
| 102(C) | PP-2 | BG-2 | 24.5 | 7.4 | 11.9 | 29.0 | 0 | −36 | −53 | −29 |
| 103(C) | I-1 | BG-3 | 21.5 | 5.6 | 12.7 | 37.9 | −2 | −5 | −4 | −37 |
| 104(C) | I-9 | BG-4 | 21.7 | 5.5 | 9.7 | 27.6 | −4 | −14 | −5 | −76 |
| 105(C) | I-13 | BG-5 | 21.3 | 5.8 | 9.8 | 31.3 | −1 | −6 | −5 | −32 |

TABLE 1-continued

| Layer structure | Layer 4 Magenta coupler | Layer 6 Cyan coupler | Secondary density (%) Magenta coupler $SD_{yellow}$ | Secondary density (%) Magenta coupler $SD_{cyan}$ | Secondary density (%) Cyan coupler $SD_{yellow}$ | Secondary density (%) Cyan coupler $SD_{magenta}$ | Dark stability $\Delta DD_{1.0}$(%) magenta | Dark stability $\Delta DD_{1.0}$(%) cyan | Light stability $\Delta DL_{1.0}$(%) magenta | Light stability $\Delta DL_{1.0}$(%) cyan |
|---|---|---|---|---|---|---|---|---|---|---|
| 106(C) | PP-1 | II-1 | 22.5 | 6.7 | 10.3 | 25.3 | −2 | −8 | −43 | −35 |
| 107(I) | I-13 | II-1 | 21.8 | 5.6 | 10.5 | 25.1 | −1 | −7 | −3 | −34 |
| 108(C) | PP-1 | II-3 | 22.8 | 6.5 | 10.1 | 25.4 | −4 | −9 | −45 | −33 |
| 109(I) | I-13 | II-3 | 21.5 | 5.5 | 10.8 | 25.3 | −1 | −9 | −5 | −37 |
| 110(C) | PP-2 | II-16 | 24.3 | 7.6 | 13.3 | 20.7 | 0 | −7 | −60 | −33 |
| 111(I) | I-13 | II-16 | 21.3 | 5.6 | 13.2 | 20.9 | −3 | −7 | −7 | −32 |
| 112(C) | PP-1 | II-24 | 22.6 | 6.5 | 10.3 | 25.6 | −3 | −9 | −43 | −37 |
| 113(I) | I-13 | II-24 | 21.9 | 5.8 | 10.9 | 25.3 | −1 | −8 | −6 | −36 |
| 114(C) | PP-2 | II-28 | 22.3 | 7.6 | 10.5 | 25.0 | −2 | −6 | −65 | −34 |
| 115(I) | I-7 | II-28 | 21.4 | 5.4 | 10.1 | 24.9 | −4 | −8 | −5 | −33 |
| 116(C) | PP-1 | I-46 | 22.8 | 6.8 | 11.0 | 25.7 | −1 | −9 | −45 | −37 |
| 117(I) | I-13 | I-46 | 21.9 | 5.6 | 11.2 | 25.6 | −2 | −7 | −6 | −34 |

As is clear from Table 1, only the combination according to the invention simultaneously exhibits very good colour reproduction, dark stability and light stability.

What is claimed is:

1. A colour photographic print material having at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the cyan coupler is of the formula II (II)

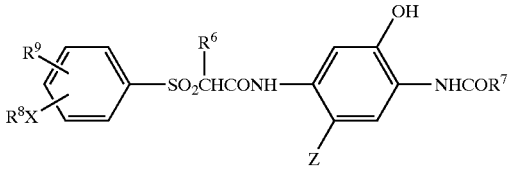

in which $R^6$ means a hydrogen atom or an alkyl group, $R^7$ means an alkyl, aryl or hetaryl group, $R^8$ means an alkyl or aryl group, $R^9$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom, Z means a hydrogen atom or a group eliminable under the conditions of chromogenic development, X means S, NH or $NR^{10}$ and $R^{10}$ means an alkyl or aryl group, and the magenta coupler is of the formula (I)

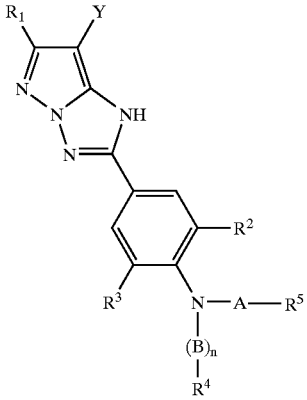

in which $R^1$ means a tertiary alkyl residue, $R^2$ and $R^3$ each mean a hydrogen atom or a substituent group, Y means a hydrogen atom, a halogen atom or an aryloxy residue, A and B each mean —CO— or —$SO_2$—, n means 0 or 1, $R^4$ means a hydrogen atom, an alkyl residue or an aryl residue and $R^5$ means an alkyl residue, an aryl residue, an alkoxy residue, an alkylamino residue or an arylamino residue or $R^4$ and $R^5$ may be joined together to form a five-, six- or seven-membered ring.

2. A colour photographic print material according to claim 1, characterised in that, in formula (II), $R^6$ means an alkyl group, $R^7$ means an unsubstituted or substituted phenyl, thienyl or thiazolyl group, $R^8$ means an alkyl group, $R^9$ means a hydrogen atom, Z means a chlorine atom and X means a sulfur atom.

3. A colour photographic print material according to claim 1, characterised in that at least 95 mol % of the silver halides of the silver halide emulsion layers consist of AgCl.

4. A colour photographic print material according to claim 1, characterised in that the yellow coupler belongs to the group of pivaloylacetanilide two-equivalent couplers.

5. The material as claimed in claim 1, wherein the cyan coupler is of the formula (II-A)

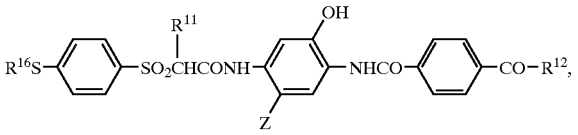

in which $R^{11}$ means a hydrogen atom or an alkyl group, $R^{12}$ means $OR^{13}$ or $NR^{14}R^{15}$, $R^{13}$ means an unsubstituted or substituted alkyl group with 1 to 6 C atoms, $R^{14}$ means an unsubstituted or substituted alkyl group with 1 to 6 C atoms, $R^{15}$ means a hydrogen atom or an unsubstituted or substituted alkyl group with 1 to 6 C atoms, $R^{16}$ means an unsubstituted or substituted alkyl group and Z means a hydrogen atom or a group eliminable under the conditions of chromogenic development and wherein the total number of the C atoms of the alkyl groups $R^{13}$ to $R^{16}$ in a coupler molecule is 8 to 18.

* * * * *

UNITED STATES PATENT AND TRADEMARK OFFICE

CERTIFICATE OF CORRECTION

PATENT NO. : 6,900,005 B2
DATED : May 31, 2005
INVENTOR(S) : Ralf Weimann et al.

It is certified that error appears in the above-identified patent and that said Letters Patent is hereby corrected as shown below:

Title page,
Item [54], Title, delete "COLOR" and insert -- COLOUR --.
Item [57], ABSTRACT,
Line 1, delete "color" and insert -- colour --.
Line 6, delete "characterized" and insert -- characterised --.
Line 13, delete "color" and insert -- colour --.

Column 35,
Line 33, delete "II" and insert -- (II) --.

Signed and Sealed this

Twenty-fifth Day of October, 2005

JON W. DUDAS
*Director of the United States Patent and Trademark Office*